US012575596B2

(12) United States Patent
Rogers

(10) Patent No.: US 12,575,596 B2
(45) Date of Patent: Mar. 17, 2026

(54) SYSTEM AND METHOD OF USE INCLUDING A REMOVEABLE INSERT FOR ROLLED SMOKING ARTICLE

(71) Applicant: Wyatt Rogers, Lawrence, KS (US)

(72) Inventor: Wyatt Rogers, Lawrence, KS (US)

(73) Assignee: OJB Enterprises LLC, Lawrence, KS (US)

( * ) Notice: Subject to any disclaimer, the term of this patent is extended or adjusted under 35 U.S.C. 154(b) by 310 days.

(21) Appl. No.: 18/223,314

(22) Filed: Jul. 18, 2023

(65) Prior Publication Data

US 2024/0016201 A1 Jan. 18, 2024

Related U.S. Application Data

(60) Provisional application No. 63/390,173, filed on Jul. 18, 2022.

(51) Int. Cl.
*A24C 5/40* (2006.01)

(52) U.S. Cl.
CPC ..... *A24C 5/40* (2013.01)

(58) Field of Classification Search
CPC ..... A24C 5/40; A24C 5/44
USPC ..... 131/280
See application file for complete search history.

(56) References Cited

U.S. PATENT DOCUMENTS 6,203,396 B1 * 3/2001 Asmussen ..... A63H 3/46 446/376
2008/0216847 A1 * 9/2008 Demmer ..... A24B 13/00 131/58
2009/0301501 A1 * 12/2009 Prevost ..... A24C 5/40 131/84.2

* cited by examiner

*Primary Examiner* — Philip Y Louie
*Assistant Examiner* — Charlotte Davison
(74) *Attorney, Agent, or Firm* — AVEK IP, LLC

(57) ABSTRACT

A removable insert for a rolled smoking article includes male and female ends. The smoking article is rolled in a roller apparatus including first and second rollers rotatably mounted in a frame. The male insert end is configured for telescopic and magnetic interconnection with the female insert end whereby the female insert end can be extracted from the smoking article and replaced with a filter. The smoking article end opposite the filter end can be crimped to complete the smoking article production.

8 Claims, 5 Drawing Sheets

SYSTEM AND METHOD OF USE INCLUDING A REMOVEABLE INSERT FOR ROLLED SMOKING ARTICLE

CROSS-REFERENCE TO RELATED APPLICATION

This application claims priority in U.S. Provisional Patent Application No. 63/390,173, filed Jul. 18, 2022, which is incorporated herein by reference.

BACKGROUND OF THE INVENTION

1. Field of the Invention

The present invention relates generally to rolled smoking articles, and in particular to a removable insert for rolled smoking articles. More specifically, the invention relates to a system and a method for producing consistent smoking articles, e.g., tobacco cigarettes and *Cannabis* joints. The insert can be used in existing cigarette rollers for accommodating smoking articles of different sizes.

2. Description of the Related Art

Tobacco, *Cannabis* and other substances are commonly smoked for enjoyment, recreation, relaxation and stimulation. Moreover, *Cannabis* is known to provide medicinal benefits and is commonly prescribed for alleviating certain health-related afflictions.

Many smokers prefer to roll their own smoking articles. For example, smoking products can be custom-blended based on individual tastes and preferences. Another objective with smoking article rollers is to achieve consistency with the cigarettes and joints produced thereby.

Heretofore there has not been available and insert for use in rolling smoking articles with the advantages and features of the present invention.

SUMMARY OF THE INVENTION

The smoking articles are formed in the roller using male and female ends which can be magnetically interconnected for extraction after the cigarette or joint is rolled with tobacco or *Cannabis* in rolling papers. The male and female ends enable placing relatively consistent amounts of tobacco or *Cannabis* in the rolling papers. The ends are easily extracted via their magnetic interconnection. One end of the smoking article can receive an accordion-style folded filter. The other end can be twisted to complete the smoking article.

DETAILED DESCRIPTION OF THE PREFERRED EMBODIMENTS

I. Introduction and Environment

Figure 1:
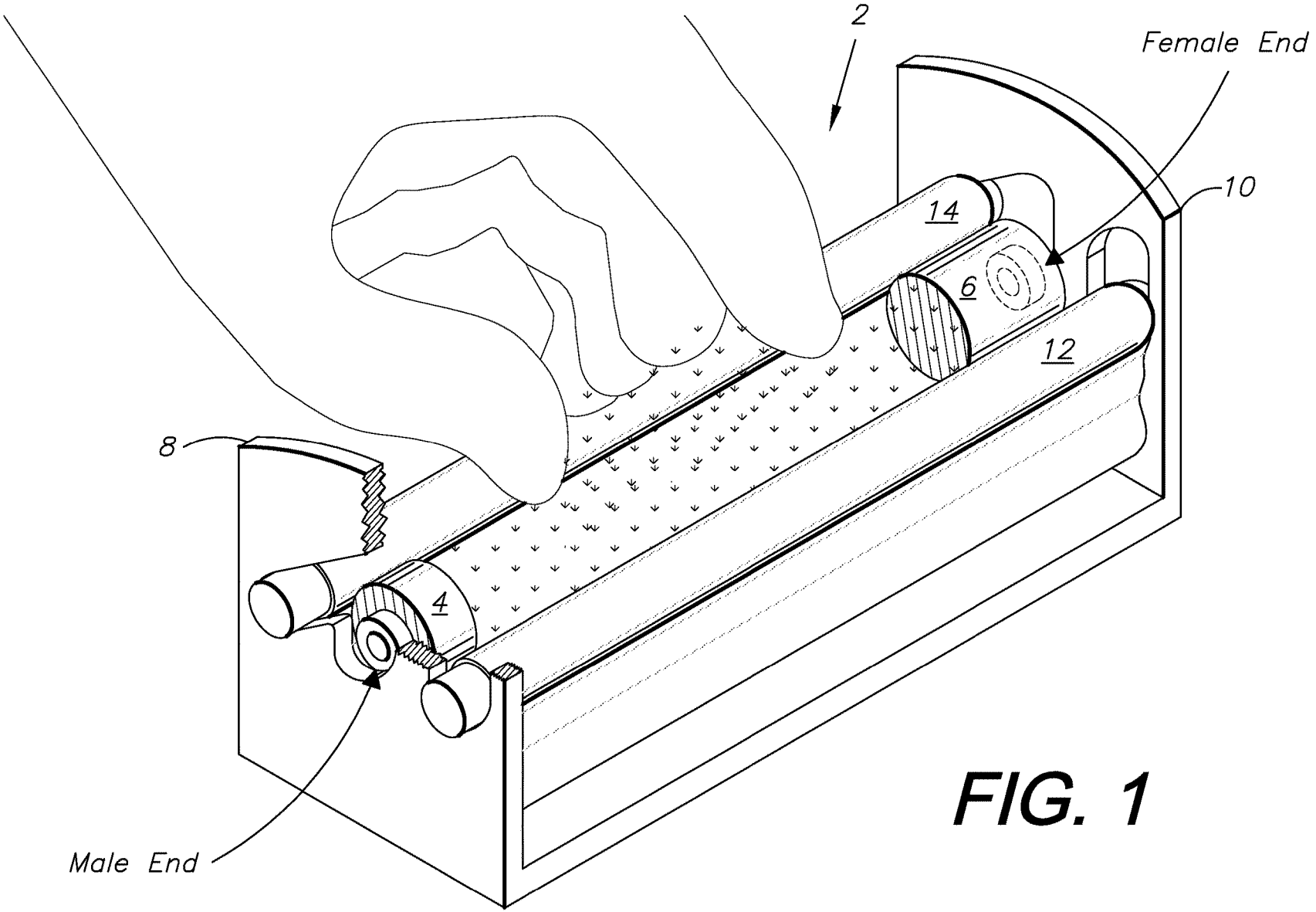
FIG. 1 is an upper perspective view of a removable insert for rolled smoking articles embodying an aspect of the present invention, shown with a smoking article roller.
Figure 2:
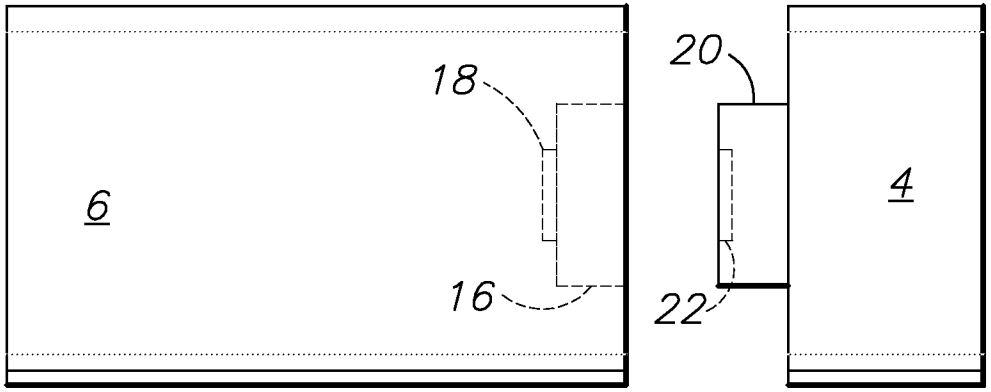
FIG. 2 is a side elevational view of the insert, showing the male and female ends thereof.
Figure 4:
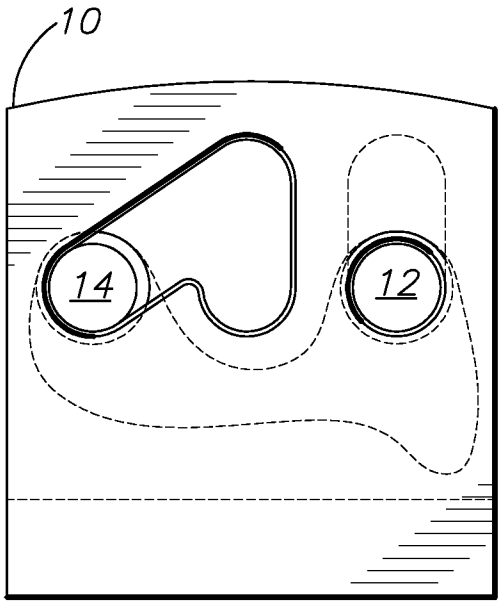
FIG. 4 is a side elevational view thereof.
Figure 3:
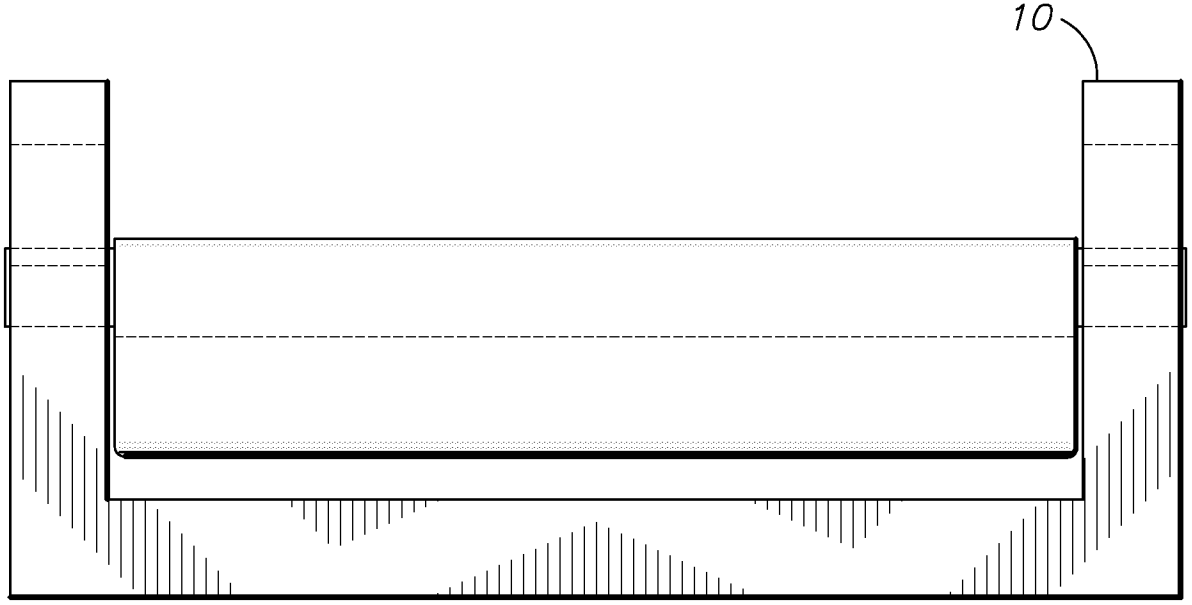
FIG. 3 is a front, elevational view thereof.
Figure 5:
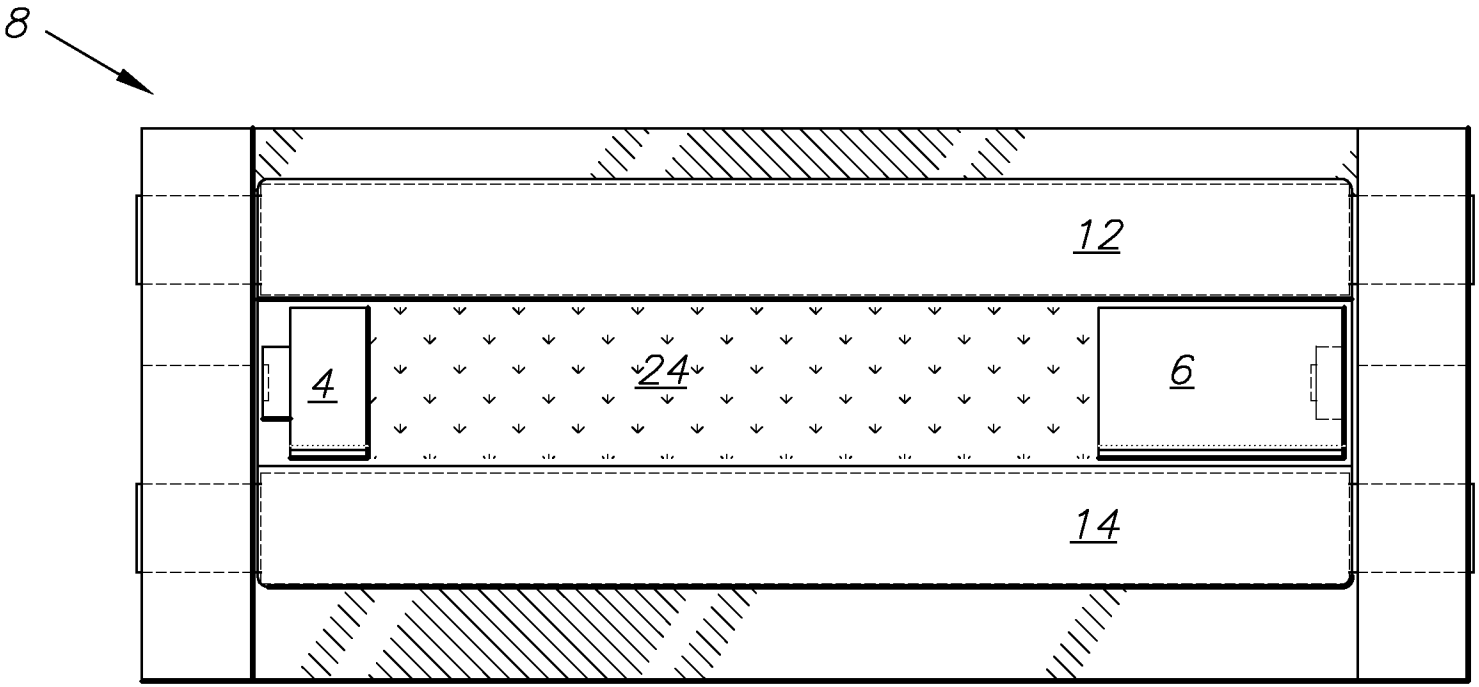
FIG. 5 is a top plan view showing smoking material placed in the roller between the inserts.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Said terminology will include the words specifically mentioned, derivatives thereof and words of similar meaning.

II. Preferred Embodiment Removable Insert 2 for Rolled Smoking Articles 34

As shown in the attached images, the present invention provides an insert 2 for forming smoking articles, such as cigarettes and joints 34, in a roller 8. The roller 8 is commercially available. The example shown includes a frame 10 rotatably and adjustably mounting first and second rollers 12, 14.

The insert 2 generally includes a removable male end 4 and a removable female end 6. The male end 4 includes a protrusion 20 concentrically mounting a magnet 22. The female end 6 includes a receiver extending with a ferromagnetic plate 18 configured for interacting with the magnet 22.

III. Method of Operation

The smoking article roller 8 is preferably adjustable to accommodate different sizes of smoking articles. A smoking product 24 is deposited in the roller 8 between the first and second rollers 12, 14. The rollers 12, 14 are then repositioned within the roller frame 10 whereby a smoking article can be rolled. A sheet of rolling paper is placed in the roller 8 for containing the smoking product 24. The positions of the individual first and second rollers 12, 14 can be adjusted to produce smoking articles of different dimensions. Moreover, different sizes of frames 10 can be utilized to provide smoking articles of different lengths.

Figure 6:
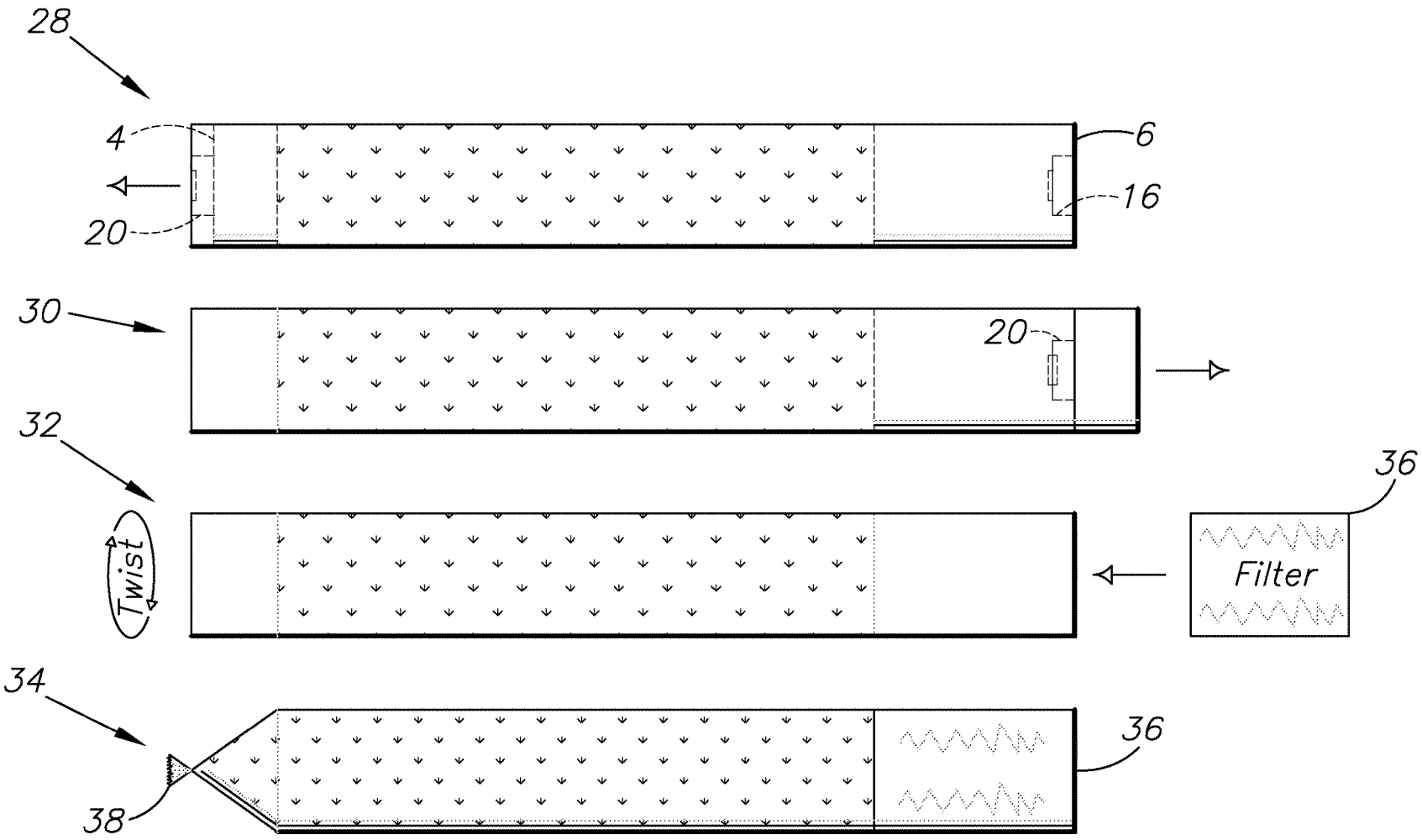
FIG. 6 shows a sequence of finishing the assembly of a smoking article using the insert of the present invention.

FIG. 6 shows the sequence for producing a smoking article 36 with the removable insert 2 of the present invention. The smoking article 28 is rolled with the male and female inserts 4, 6 in place and a quantity of smoking product 24 in position therebetween. The smoking article 30 has the male insert end 20 removed from the left end and placed on the smoking article right end. The insert ends 4, 6 magnetically engage with the protrusion 20 positioned in the receiver 16. The magnetic engagement enables extracting the female end 6 by pulling outwardly on the male end 4. The smoking article shown at 32 has open cavities at both ends. The resulting male end cavity leaves space for twisting the end 38 of the smoking article for lighting. The resulting female end cavity can receive a filter 36, which can be accordion-folded. Alternatively, various types of filters can be utilized with the present invention.

It should further be noted that the invention can be fabricated from various suitable materials. Still further, various smoking substances and rolling papers can be utilized. For example, rolling papers are commonly available and can be utilized with the roller of the present invention.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A system for rolling a smoking article, the system comprising:

a roller apparatus comprising first and second rollers rotatably received in a frame, said roller apparatus further comprising a first end and a second end;

a removeable insert comprising a first portion and a second portion;

said first portion comprising a generally cylindrical male end including a concentric protrusion concentrically mounting a magnet;

said second portion comprising a generally cylindrical female end including a receiver mounting a ferro-magnetic plate;

said first portion and said second portion configured to be placed in a first, stored orientation with said concentric protrusion configured to be received within said receiver;

said first portion and said second portion configured to be placed in a second, deployed orientation with said first portion configured to be placed at said first end of said roller with said concentric protrusion facing toward the frame of the roller apparatus, and thereby away from said second portion, and said second portion configured to be placed at said second end of said roller with said receiver facing toward the frame of the roller apparatus, and thereby away from said first portion;

wherein said first portion and said second portion are configured to be placed within a rolling paper, and wherein a smoking material is configured to be placed within said rolling paper between said first portion and said second portion;

wherein said first portion and said second portion are configured to facilitate rolling the smoking article within the rolling apparatus; and wherein said first portion is thereafter configured to be removed from a first end of the smoking article, thereby forming a first cavity within the smoking article formed by said rolling paper, and wherein said second portion are thereafter configured to be removed from a second end of the smoking article, thereby forming a second cavity within the smoking article formed by said rolling paper.

2. The system of claim 1, further comprising:

said second portion configured to be removed from said second end of the rolling article by interfacing said receiver with said concentric protrusion of said first portion such that said first portion and said second portion are magnetically connected; and said first portion is thereafter pulled away from the smoking article, thereby withdrawing said second portion.

3. The system of claim 1, wherein said rolling paper about said first cavity is configured to be twisted, thereby sealing the smoking article.

4. The system of claim 1, wherein said second cavity is configured to receive a filter element therein.

5. A method of rolling a smoking article, the method comprising the steps:

providing a rolling apparatus including a pair of rollers within a frame, a first end, and a second end;

providing a removeable insert apparatus including a first portion and a second portion, wherein said first portion comprises a generally cylindrical male end including a concentric protrusion concentrically mounting a magnet, and wherein said second portion comprises a generally cylindrical female end including a receiver mounting a ferro-magnetic plate;

positioning said removable insert apparatus into a stored orientation by connecting said concentric protrusion of said first portion within said receiver of said second portion;

separating said first portion and said second portion;

placing said first portion within the rolling apparatus between the pair of rollers at said first end of the rolling apparatus such that said concentric protrusion points towards the frame of the rolling apparatus;

placing said second portion within the rolling apparatus between the pair of rollers at said second end of the rolling apparatus such that said receiver points toward the frame of the rolling apparatus, such that said receiver and said concentric protrusion are pointing in opposite directions along an axis through a centerline between the rollers of the rolling apparatus;

placing smoking material within the rolling apparatus between the pair of rollers and between said first portion and said second portion of said removable insert;

inserting a rolling paper between the pair of rollers around said smoking material and said first portion and said second portion of said removable insert;

rolling the smoking article with the roller apparatus;

creating a first cavity within the smoking article at a first end thereof with said first portion of said removable insert, said first cavity formed by said rolling paper;

creating a second cavity within the smoking article at a second end thereof with said second portion of said removable insert, said second cavity formed by said rolling paper;

removing the smoking article from the rolling apparatus; and removing said first portion and said second portion of said removable insert from the smoking article.

6. The method of claim 5, further comprising the steps:

inserting said concentric protrusion of said first portion into said receiver of said second portion, thereby magnetically connecting said first portion and said second portion; and removing said second portion from the smoking article by pulling against said first portion.

7. The method of claim 5, further comprising the step of twisting said rolling paper about said first cavity is configured to be twisted, thereby sealing the smoking article.

8. The method of claim 1, further comprising the step of inserting a filter element into said second cavity.

* * * * *